United States Patent [19]

Francis

[11] Patent Number: 4,545,884

[45] Date of Patent: Oct. 8, 1985

[54] HIGH FREQUENCY ELECTROPLATING DEVICE

[76] Inventor: William L. Francis, 18 Chimney Wood, Floyd Knobs, Ind. 47119

[21] Appl. No.: 612,244

[22] Filed: May 21, 1984

[51] Int. Cl.[4] ..... C25D 17/00; C25D 17/06; C25D 17/28

[52] U.S. Cl. ..... 204/202; 204/222

[58] Field of Search ..... 204/200, 201, 202, 224 R, 204/222, 15

[56] References Cited

U.S. PATENT DOCUMENTS

| | | | |
|---|---|---|---|
| 2,744,860 | 5/1956 | Rines | 204/222 |
| 3,351,539 | 11/1967 | Branson | 204/222 |
| 3,657,097 | 4/1972 | Baldock | 204/202 |
| 3,878,062 | 4/1975 | Grimaldi | 204/15 |
| 3,904,489 | 9/1975 | Johnson | 204/15 |
| 3,966,581 | 6/1976 | Holte | 204/15 |
| 4,032,414 | 6/1977 | Helder | 204/202 |
| 4,035,245 | 7/1977 | Danneels | 204/202 |
| 4,404,078 | 9/1983 | Francis | 204/202 |

*Primary Examiner*—Thomas Tufariello
*Attorney, Agent, or Firm*—Edward M. Steutermann

[57] ABSTRACT

Method and apparatus for continuous electroplating of selected portions of the inside of elongate generally tubular metallic articles including a moving conveyor to receive the articles so the portion of article to be electroplated extends downwardly from the conveyor and is received in a receiver which shields the outside of the article whereby the portion to be electroplated is passed through at least one cell containing electroplating liquid as the conveyor moves and the portion of the article to be electroplated contacts the liquid in the cell wherein the processing liquid is agitated at at least sonic frequency enhance capillary action to effect contact of the liquid with the inner surface of the portion of the part exposed to the liquid.

4 Claims, 6 Drawing Figures

HIGH FREQUENCY ELECTROPLATING DEVICE

BACKGROUND OF THE INVENTION

The present invention relates to the art of electroplating and particularly to the art of electroplating small articles, for example portions of the interior of small tubular metallic parts where the electroplated portions are used in the electronics industry as contact surfaces and relates more particularly to the art of goldplating the inner surface of tubular electronic components.

The growth and increased sophistication of the electronics industry has led to the need for electroplated components and particularly for electoplated contact areas of various description where the contact areas are usually electroplated with gold which has been found to be particularly effective to prevent corrosion and erosion of contact areas and maintain reliable electrical conductivity of the components.

Gold has become recognized as the leading plating material because of its relative unalterability, good solderability and low contact resistance.

The prior art teaches one method for plating of such contacts which has become known as "barrel plating" where the articles are tumbled in a barrel of plating liquid for application of the plating.

The barrel plating method is expensive because of the increased price of gold coupled with the use of excess material required in such procedures because of the waste of plating fluid and because such techniques are not specific as to areas to be electroplated and lead to plating unnecessary areas and overplating. Accordingly, the use of techniques to plate only contact surfaces as provided by the present invention have come to be appreciated.

One prior art arrangement for selective plating is shown in U.S. Pat. No. 3,904,489 which utilizes a porous felt type applicator which is used to apply the electroplating solution to the parts which are carried by a continuous belt by insertion therethrough. However, this technique is generally ineffective to accomplish plating of the inner surface of a tubular post.

Another prior art arrangement which is an improvement in the aforenoted arrangement is shown in U.S. Pat. No. 3,966,581.

Another arrangement is shown in my U.S. Pat. No. 4,404,078 to apparatus which can be utilized in the electroplating of elongate parts including tubular parts but are not limited thereto.

U.S. Pat. No. 3,878,062 teaches a method for selective plating through the use of direct impingement of the electroplating solution and U.S. Pat. No. 3,657,097 teaches the use of solution height adjustment for selective plating. Also U.S. Pat. No. 4,032,414 teaches carriages to transfer two pin strips through electroplating solutions and U.S. Pat. No. 4,035,245 teaches control of electroplating systems through fluid control vanes which regulate flow of the electroplating fluid to effect selectivity.

One prior art method shown in German Pat. No. 2,019,178 teaches agitation of the electroplating bath to plate non moving parts in an electroplating bath but none of the known prior art references teaches vibration of the bath at ultrasonic frequency to effect the plating of the inside of tubular articles.

Further, no prior art device is known to accomplish continuous electroplating of the inside of a portion of tubular articles where the articles are carried in selected orientation in a receiver which covers the outside of the part which is conveyed through an electroplating bath by a moving conveyor where the parts are dipped in the bath to electroplate only inside portions thereof while electrical contact is maintained from a contact strip in contact with the article while the downwardly depending portion of the article to be electroplated is immersed in the electroplating solution and the solution is vibrated at ultrasonic frequency.

SUMMARY OF THE INVENTION

The present invention provides a straightforward economical means for electroplating selected areas of the inside small tubular metallic articles.

Further, devices within the scope of the present invention provide means to rapidly and efficiently electroplate areas of the inside of tubular metallic articles, without waste of the electroplating solution or overplating.

It has been found that simple agitation of the bath of plating solution does not significantly affect the quality of the plating applied to the interior of tubular article but that ultrasonic vibration of the bath does significantly affect the uniformity and quality of the plating process. While the effects provided by the present invention are not fully understood, it is believed that in prior arrangements the plating liquid may be drawn into the interior passageway of the tubular part but the liquid inside the part remains quiescent and essentially only the liquid initially introduced to the part contributes to the plating and the concentration of the electroplating metal is depleted within the article so that in many instances it is not possible to obtain sufficient plated metal thickness. Further it has been found that while capillary action plays a part in drawing the electroplating fluid into the tubular element the capillary action is enhanced by the utilization of high frequency agitation of the electroplating bath. It has been found in accordance with the present invention, that the effectiveness of the internal plating of tubular articles is relatively unaffected by agitation at less than ultrasonic frequency but is significantly affected by vibration of the bath at at least sonic frequency.

More particularly, the present invention provides a method and apparatus for continuous electroplating of selected portions of the inside of elongate generally tubular metallic articles including a moving conveyor to receive the articles so the portion of article to be electroplated extends downwardly from the conveyor and is received in a receiver which shields the outside of the article whereby the portion to be electroplated is passed through at least one cell containing electroplating liquid as the conveyor moves and the portion of the article to be electroplated contacts the liquid in the cell wherein the processing liquid is agitated at at least sonic frequency enhance capillary action to effect contact of the liquid with the inner surface of the portion of the part exposed to the liquid.

BRIEF DESCRIPTION OF THE DRAWINGS

One example of a method and apparatus, in accordance with the present invention is disclosed in the accompanying drawings where.

DETAILED DESCRIPTION OF THE DRAWINGS

Figure 1:
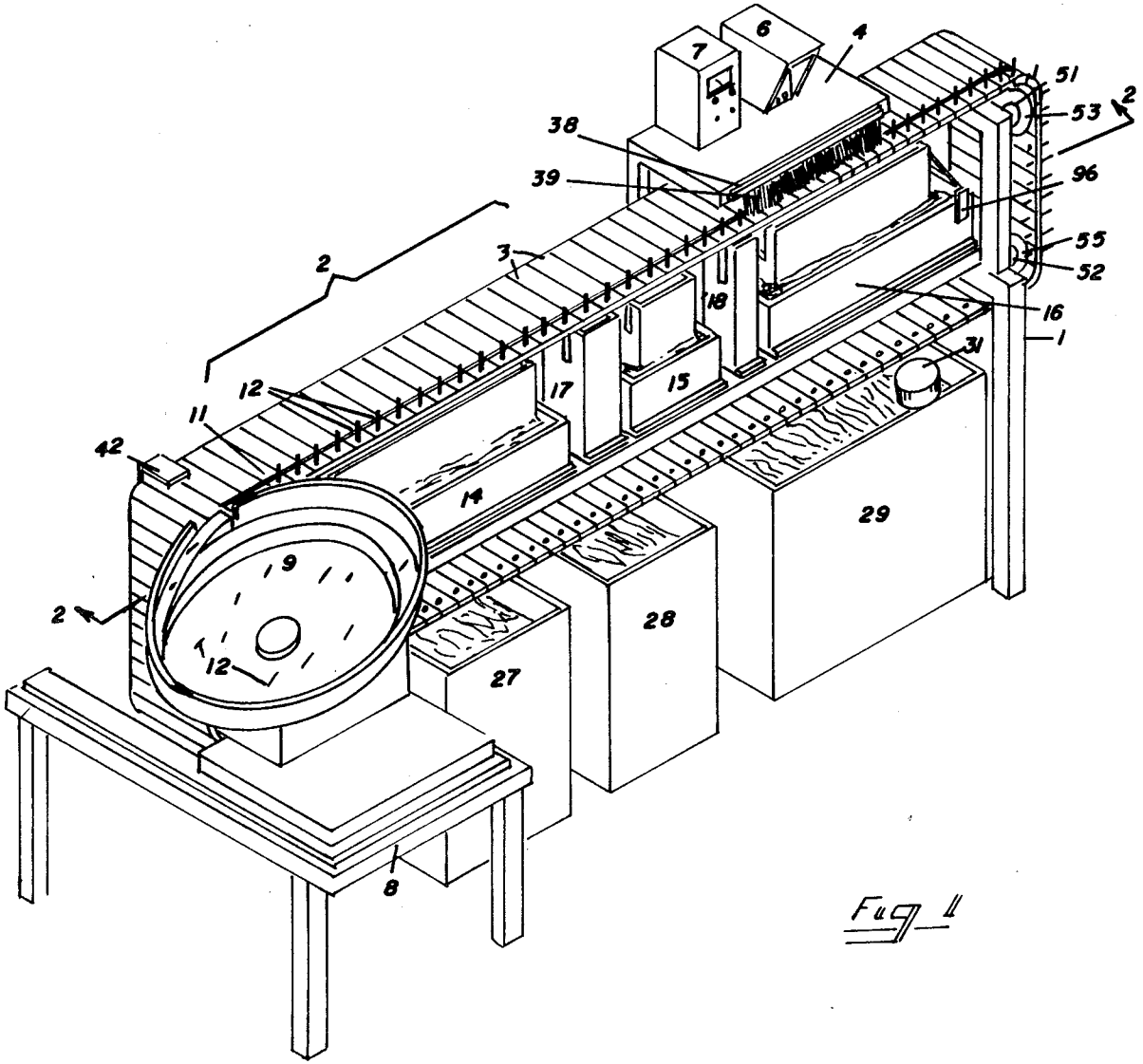
FIG. 1 is a perspective view of one example of a plating device.

Referring first to FIG. 1 an arrangement is shown including a frame assembly 1 to support a tractor tread conveyor 2 composed of separate conveyor sections 3 linked together to form a continuous conveyor device. A shelf 4 is provided above conveyor 2 to hold a rectifier 6 and temperature controller 7 to control operation and characteristics of a fluid in an electroplating section 16 as described hereinafter.

Figure 2:
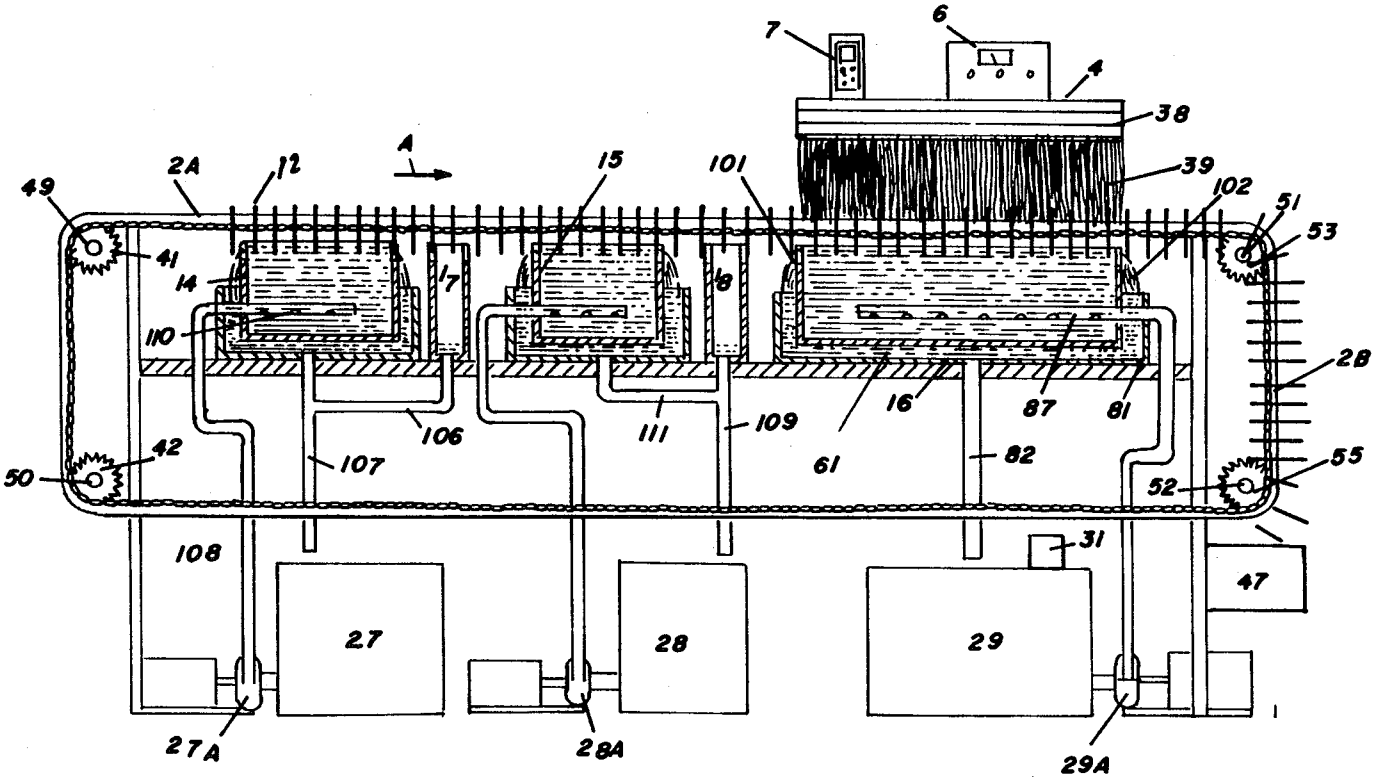
FIG. 2 is a view taken along a plane passing through line 2—2 of FIG. 1.

As also described hereinafter, a feeder 9 for example a Syntron° vibrating feeder by FMC Corporation can be placed on a shelf 8 to orient and individually feed parts 12, for example tubular metal parts to be plated through a chute 11 where the chute and feeder orient the parts in generally vertical relation and feed them to spaced apertures in conveyor assembly 2 for travel through the electroplating stations as described hereinafter. Conveyor 2 travels around cooperative sprockets 41–44 located in spaced relation at opposite ends of frame 1 as shown in FIG. 2 to define the conveyor path. A guide 46 can be provided at the entry end of conveyor 7. The conveyor travels as is shown in FIG. 2 by arrow A. The electroplating occurs on the upper run of conveyor 2 shown in FIG. 2 where parts 12 are loaded into conveyor 2 and travel with conveyor 2 through the plating run 2A and a vertical conveyor run 2B to drop into a receptacle 47.

Sprockets 41–44 are carried by shafts 49–52, journaled on frame 1 by means, for example of journals 53–55 for shafts 51,52 as shown in FIG. 1 and similar journals for shafts 49 and 50 (not shown). Shafts 49–51 are idler sprockets while shaft 52 drives sprocket 44 (and conveyor 2 which drives sprockets 41–43) by means of a drive motor (not shown). The character of the plating received by the outer surface of the parts can be determined by the time of exposure to the solution in the various cells where the exposure time can be varied by the speed of conveyor 2 and the concentration of solution and current density in electroplating cell and temperature of the electroplating solution.

While the processing of parts may vary from application to application depending on the characteristic of the parts, as shown in FIG. 1 a typical device can include several processing stations including, in this case, an acid bath 14, a rinse bath 15, and a goldplate bath 16. A liquid receptacle 17 is provided after acid bath 14 and a second liquid receptacle 18 is provided after acid bath 14 to receive and recycle liquid.

It will be understood that other processes can be included in devices within the scope of the present invention or that certain of the process stations included herein can be eliminated without departing from the scope of the present invention.

Figure 3:
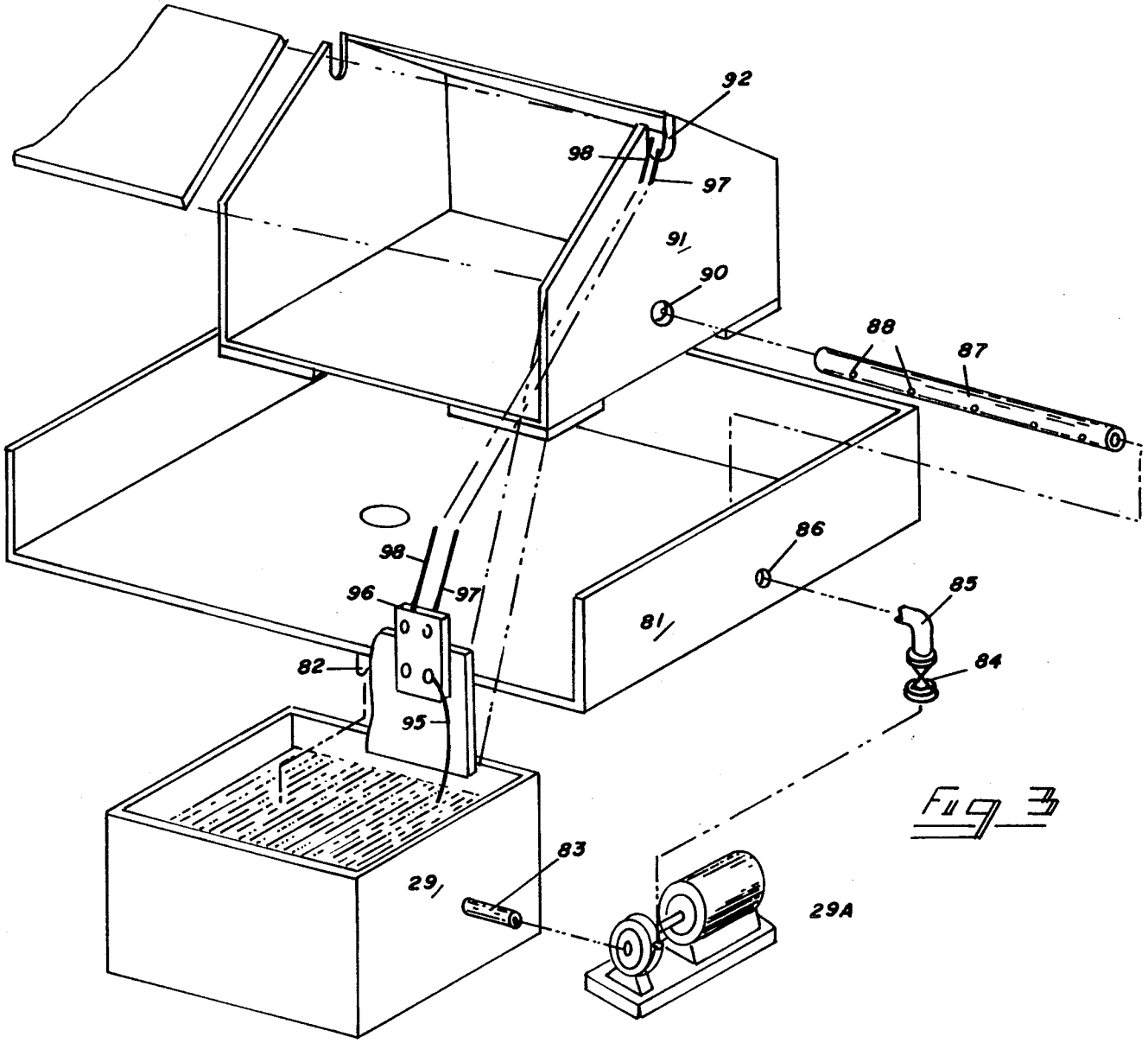
FIG. 3 is an exploded perspective view of a solution cell of the type useful in an arrangement of the type shown in FIG. 1.

Each of the processing stations 14–16 in FIG. 3 includes a reservoir 27–29 respectively and pumps 27A–29A for continuous circulation of selected fluid to the assembled cell, to control the liquid level in the cells to control the depth exposure of the part in the liquid. In certain processes it is helpful to control the temperature of the fluid to which the parts are exposed and in the arrangement shown a heater 31 is provided and operated by heat controller 7 by appropriate interconnection (not shown) for controlling the temperature of the liquid in reservoir 29 which supplies the electroplating solution.

Referring to FIG. 1 a metallic conductive brush 39 is connected to shelf 4 by means of a bracket 38 to extend downwardly from the shelf and contact an electrically conductive portion of the conveyor as the parts to be plated move through the electroplating station 16. Brush 38 is connected by means of a connector (not shown) to rectified power supply 6 and generally supplies cathode connection during the electroplating process. The solution in the electroplating cell 16 acts as the annode as described hereinafter and known in the art so a circuit is completed through the parts 12 to effect the electroplating of the portion of the parts exposed to the liquid.

Conveyor 2 is driven by sprockets 41–44 which mesh with appropriate linkages (not shown) provided on the he underside of conveyor 2 for example lugs fastened to the bottom of each conveyor section.

It will be understood that a guide means (not shown) can be provided and supported by frame 1 to receive the linkage assemblies for purposes of providing lateral stability to the conveyor section as the parts are directed through the processing stations.

Each of the processing stations is substantially the same except that stations 14 and 15 have no electrical connections.

FIG. 3 is an exploded view of a typical processing station, in this case electroplating station, which is shown principally for purposes of showing the position of electrodes which form the annode along with the solution contained within the station and the provision of the ultrasonic generator. In FIG. 3 an outer reservoir 81 is shown which can, as shown, be generally rectangular and has a central drain 82 for emission of fluid from the reservoir 81. Fluid from reservoir 82 flows as shown and described hereinafter by gravity to, for example, reservoir 29 for recycling. As previously described in some cases temperature control means are provided within the reservoir such as the heater 31 shown in FIG. 1. Pump 29A is shown which communicates with an outlet 83 from reservoir 29 to recirculate fluid through a valve 84 provided to adjust the level of liquid in the inner reservoir as described hereinafter so that fluid level is adjusted to contact the parts 12 to a selected level establishing a plating line. An inlet 85 is connected through an aperture 86 of reservoir 81 to a sparger 87 having apertures 88 for emission of fluid from sparger 87. Fluid is emitted from spargers 88 in, for example, a downward direction where sparger 87 is located in an inner reservoir 91. Inner reservoir 91, which is shown with the sides exploded, provides generally upwardly frusto triangular endwalls each having a terminal groove 92 where in operation the electroplating fluid flows outwardly through the grooves 92 as described with reference to FIG. 5. The grooves 92 are provided to allow movement of the downwardly extending portions of the parts 12 to be plated through reservoir 91 in contact with the fluid. An annode connection 96 is provided on one side wall of reservoir 91 and connected to rectifier 7 by means of a lead 97. Probes 97 and 98 are provided from connection 96 where probe 99 is located outside slot 92 and probe 98 is L shaped and extends into slot 92 to contact the liquid. To assure contact a similar arrangement can be provided at the other end of reservoir 91 in conjunction with slot 92. Spacers 99 are provided on the underside of reservoir 91 to rest on the base of reservoir 81 to provide a separation of the base of reservoir 91 and the base of reservoir 81 to allow flow of liquid into drain 82. Reservoir 91 is of lesser length than reservoir 91 and can be of lesser width than reservoir 81 to allow a peripheral area within between the wall of reservoir 81 and reservoir 92 to allow a level of fluid in reservoir 81.

Figure 5:
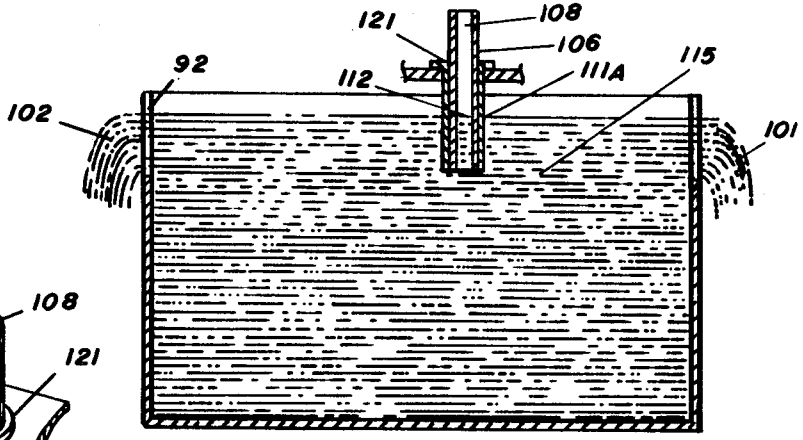
FIG. 5 is a view illustrating the operation of a cell of the type shown in FIG. 4, in accordance with one example of the present invention.
Figure 6:
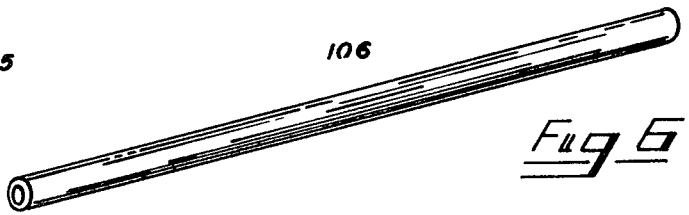
Figure 4:
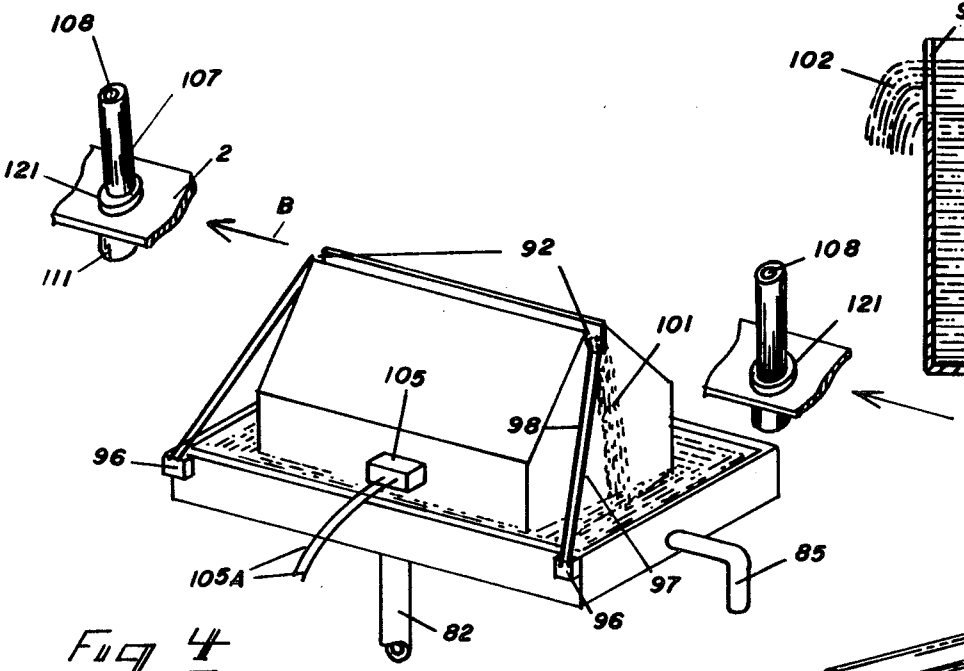
FIG. 4 is an assembled view of a solution cell of the type shown in FIG. 3 with an ultrasonic vibration source in place.

Referring now to FIG. 4 which is an illustration of the cell shown in FIG. 3 in assembled form a stream of electroplating fluid 101 overflows through groove 92 and a similar stream 102 overflows through opening 92 at the opposite end. In accordance with the present invention an ultrasonic generator 105 is located in an appropriate position to agitate the fluid contained in cell 91. In the arrangement shown generator 105 is located on the side wall of cell 91 so that the vibrations are transmitted through the wall of cell 91 and into the liquid. It will be understood that depending on the configuration of cell 91 several generators can be provided. A part to be plated 106 is shown in more detail in FIG. 6 is shown in position to be admitted to groove 92 traveling in direction shown by arrow B. The part 106 is tubular having a central opening 108 and is received in a holder 121 which is received in conveyor 2A where as shown in FIG. 5 holder 121 receives part 106 and covers the length of the part to protect the outside of the portion exposed to the part from the electroplating solution so that only the inside of the part is plated to the depth to which the electroplating fluid rises in opening 108 as shown by level 112. A second part 107 is shown in the position it would be after emission from cell 91 but still in holder 121. As shown in FIGS. 4, 5 and 6, part 106 is hollow having a inner passageway 108 where it is desired to electroplate the lower portion of the passage 108. FIG. 5 is an illustration of the orientation of part 106 and the liquid level 112 in cell 91. In some instances because of the character of the electroplating solution and the character of the part 106 a form of capillary action occurs so that the liquid level within the part may rise to a position shown by reference numeral 112 above the level of the liquid in cell 91 shown by reference numeral 113. Nonetheless a cylinder of liquid is retained in part 106 in passage 108 and electroplates the inside surface of part 106.

In accordance with the present invention it has been found that the column of liquid received within passageway 108 of part 106 is less effective than would be expected for purposes of electroplating the inner surface of part 106 but it has been found that by ultrasonic vibration of the liquid 115 in cell 91 the effectiveness of the electroplating accomplished by the column of liquid in passage 108 is greatly enhanced and a more uniform and better control electroplating process occurs particularly with respect to the internal surface of part 106.

While no specific frequencies have been found to effect the improvements by the subject invention it has been found that vibration at greater than sonic frequency range are necessary to accomplish the objectives of the present invention.

Referring now to station 14, the acid work station, fluid flow is similar except that there are no electrodes in the acidizing station 14. The solution is a selected acid, as is known in the art, for example hydrochloric, or other acid suitable for preconditioning the parts 12 to be plated. The receptical 17 is provided and as shown has grooves similar to grooves 92 of reservoir 91 to allow passage of the parts to be plated. Fluid drips from the parts and is returned by means of a drain 106 to drain 107 from station 14. The acid is stored in the reservoir 27 and supplied by means of pump 27 through an outlet 108 to a sparger 109 located within station 14.

A similar arrangement is provided with respect to the rinse section 15 where a receptacle 18 is provided after station 15 for drainage and the fluid is then returned to reservoir 28 by means of a drain 109 from receptacle 18 and 111 from station 15.

In operation parts are loaded in bulk in feeder 9 where the parts are automatically separated and supplied to chute 11 where they are turned to a generally vertical orientation and supplied to the holders 121 carried in apertures of the plates carried by the links of conveyor 2. The parts pass in vertical orientation through the processing station 14–15 and 16 as previously described and are then dumped into receptacle 47 as plated parts.

It will be understood that the foregoing is but one example of method and apparatus within the scope of the present invention and that various other methods and apparatus also within the scope of the present invention will occur to those skilled in the art upon reading the disclosure set forth herein.

The invention claimed is:

1. Apparatus for continuous electroplating of a portion of the inner surface of an elongate generally tubular metallic article s including:

(a) moving conveyor means having tubular elongate electrically nonconductive holder means to receive said articles so the portion of article to be electroplated extends downwardly from the conveyor to the end of said holder means;

(b) solution reservoir means to receive a selected solution to contact the parts to be electroplated where the reservoir is located beneath the conveyor means in aligned relation with the conveyor means so the portion of the articles to be electroplated pass through the solution in the reservoir with movement of the conveyor; and (c) vibration generating means to vibrate the solution in the reservoir at a frequency greater than sonic frequency.

2. The invention of claim 1 including electrical contact means to contact the articles to be electroplated while said article s are exposed to said solution in said reservoir and second electrical contact means to provide an electrical source of polarity opposite to the polarity of the first contact to the solution wherein the solution is an electrolyte.

3. The invention of claim 1 wherein said reservoir includes opposite end walls having downwardly extending grooves therein wherein said articles are received through said grooves in passing through said reservoir and wherein the solution in said reservoir overflows through said grooves.

4. The invention of claim 3 including second reservoir means disposed beneath said reservoir means whereby fluid overflowing from said grooves is received in said second reservoir means for recirculation to said reservoir means.

* * * * *